US006190149B1

(12) United States Patent
Richman

(10) Patent No.: US 6,190,149 B1
(45) Date of Patent: Feb. 20, 2001

(54) VACUUM PUMP OIL DISTRIBUTION SYSTEM WITH INTEGRAL OIL PUMP

(75) Inventor: Jay Richman, King of Prussia, PA (US)

(73) Assignee: Stokes Vacuum Inc., Philadelphia, PA (US)

( * ) Notice: Under 35 U.S.C. 154(b), the term of this patent shall be extended for 0 days.

(21) Appl. No.: 09/294,647

(22) Filed: Apr. 19, 1999

(51) Int. Cl.[7] ..... F04C 15/00

(52) U.S. Cl. ..... 418/94; 418/88; 418/97; 418/98; 418/60; 418/188

(58) Field of Search ..... 418/88, 94, 98, 418/97, 60, 188

(56) References Cited

U.S. PATENT DOCUMENTS

| | | | | |
|---|---|---|---|---|
| 3,743,453 | * | 7/1973 | Abendschein et al. | 418/88 |
| 3,744,942 | * | 7/1973 | Mount | 418/76 |
| 3,782,868 | * | 1/1974 | LeBlanc, Jr. | 418/83 |
| 3,877,851 | * | 4/1975 | Komiya et al. | 418/76 |
| 3,877,853 | * | 4/1975 | Harlin | 418/88 |
| 4,429,924 | | 2/1984 | Franz et al. . | |
| 4,470,767 | | 9/1984 | Frings et al. . | |
| 4,478,562 | * | 10/1984 | Schippers et al. | 418/88 |
| 4,483,667 | | 11/1984 | Berges et al. . | |
| 4,519,755 | * | 5/1985 | Hanson | 418/9 |
| 4,525,129 | | 6/1985 | Berges et al. . | |
| 4,639,199 | | 1/1987 | Frings et al. . | |
| 4,702,205 | * | 10/1987 | David | 418/99 |
| 4,734,606 | | 3/1988 | Hajec . | |
| 4,838,772 | * | 6/1989 | LeBlanc | 418/13 |
| 4,919,599 | | 4/1990 | Reich et al. . | |
| 4,940,341 | | 7/1990 | Schuetz et al. . | |
| 5,035,590 | | 7/1991 | Steffens . | |
| 5,312,192 | | 5/1994 | Shimuzu et al. . | |
| 5,409,358 | * | 4/1995 | Song | 418/88 |

FOREIGN PATENT DOCUMENTS

| | | | | |
|---|---|---|---|---|
| 3-175189 | * | 7/1991 | (JP) | 418/94 |
| 3-175191 | * | 7/1991 | (JP) | 418/94 |

OTHER PUBLICATIONS

Stokes® Vacuum Inc. "Microvacpump Instructions" for Model 900–412–011 Microvac Pump (Rev. 1.6 dated Jan. 26, 1995), 6 pages.

* cited by examiner

*Primary Examiner*—Thomas Denion
*Assistant Examiner*—Theresa Trieu
(74) *Attorney, Agent, or Firm*—Synnestvedt & Lechner LLP

(57) ABSTRACT

An oil distribution system for machinery such as a vacuum pump is disclosed. The system features an auxiliary oil pump integrally mounted adjacent to one end of the vacuum pump's drive shaft. The drive shaft drives the oil pump and has a longitudinal passage extending substantially along its length in communication with the outlet from the oil pump. Oil ports, positioned at points along the drive shaft adjacent to bearings supporting the drive shaft, extend from the passage. Lubricating oil, drawn from a reservoir by the oil pump, is pumped into the passage. The oil exits the passage via the oil ports and lubricates the bearings. The oil passes into the pump cylinder where it provides an oil seal between the piston and cylinder wall. Either a rotary vane pump or a gerotor-type pump is preferred as the auxiliary oil pump.

28 Claims, 9 Drawing Sheets

12
14
15
16
18
20
22
24
26
28
29
30
31
46
48
56
60
62
64
66
74

VACUUM PUMP OIL DISTRIBUTION SYSTEM WITH INTEGRAL OIL PUMP

FIELD OF THE INVENTION

This invention relates to vacuum pumps having integrally mounted oil pumps for supplying oil for lubricating shaft bearings and sealing the pump piston(s).

BACKGROUND OF THE INVENTION

Vacuum pumps are widely used across a broad spectrum of industrial applications including, for example, the manufacture of vacuum coated automotive products, the environmental testing of spacecraft, chemical manufacturing process applications and biological and medical research.

Typical mechanical vacuum pumps have some form of piston which reciprocates or rotates within a cylinder to effect the removal of gas from a chamber or vessel to which the pump intake is connected. Large capacity pumps may have multiple piston-cylinder combinations. The piston or pistons are commonly driven by a shaft mounted on bearings within the vacuum pump. The bearings and pistons must constantly be kept lubricated to avoid problems caused by excessive friction between moving parts such as excessive wear, piston overheating leading to piston seizure and bearing overheating leading to bearing failure. Lubricating oil is commonly used to lubricate the moving parts of the vacuum pump. The lubricating oil also serves a second function in that it forms the necessary gas tight seal between the piston and cylinder ensuring that the gas displaced by the vacuum pump piston(s) does not leak back across the piston-cylinder interface from the high pressure side to the low pressure side of the pump.

A known method for supplying sealing/lubricating oil to shaft bearings and the piston and cylinder is by a combination of gravity feed, centrifugal force and differential pressure. An oil reservoir from which oil flows under gravity is positioned immediately above the pump. Oil lines connect the reservoir to the end caps of the vacuum pump where oil flows into the cylinders through two paths: (1) through the bearings and thence through metering rings; and (2) through oil feed ducts in the vacuum pump side covers. Where a center shaft bearing is provided, oil to one of the end caps is also conducted through a longitudinal axial passage in the shaft connected to an extended port opening onto the bearing.

The natural oil flow from the reservoir is augmented by maintaining the reservoir at atmospheric pressure and conducting the oil into the cylinder of the pump when it is under vacuum and after the oil has lubricated the bearings or other moving parts. Thus, the oil tends to flow through the pump under gravity, the centrifugal force of the rotating shaft and is also forced through the pump by a pressure differential between the reservoir and the pump cylinder. The oil is expelled from the cylinder along with the gas displaced by the vacuum pump piston(s). The gas/oil mixture passes through a separator where the oil is separated from the gas and the oil is returned to the reservoir while the gas is expelled to the atmosphere.

Although this oil distribution system has proved practical under many circumstances, there are conditions wherein the gravity/differential pressure system of lubrication does not supply sufficient oil to effectively lubricate the bearings and seal the piston(s) of the vacuum pump.

As an example, when a vacuum pump is evacuating a relatively large vessel, such as a large vacuum chamber capable of holding a spacecraft for vacuum testing, oil distribution can be a problem. During an initial period of operation of the pump, there will be almost no pressure difference between the cylinder pressure and the atmospheric pressure in the reservoir, thus, there will be no pressure differential augmenting the oil flow from the reservoir. This situation is due to the relatively small volume of the cylinder compared with the much larger chamber volume. Each stroke or rotation of the piston removes a relatively small volume of gas from the chamber, and it may take several minutes, depending upon the chamber size, before any appreciable pressure differential is realized within the chamber and the cylinder. During this initial phase of vacuum pump operation, the oil flows only under gravity and not by any pressure differential. Adequate oil for lubrication and piston/cylinder sealing may not be obtainable under gravity flow alone, leading to increased wear of pump parts and shorter pump life. Catastrophic pump failure could also result in the form of a piston seizure or bearing failure.

Another example is when pressure in the reservoir is reduced by an auxiliary vacuum pump to remove volatile process materials that collect in the oil. If not removed from the oil in the reservoir, the volatile materials re-expand in the cylinders, increasing cylinder pressure above the desired level. The volatiles may also adversely affect the lubricating qualities of the oil. Reduction of reservoir pressure, however, removes the differential pressure component that induces oil flow.

One method of supplying adequate sealing and lubricating oil to vacuum pump pistons and bearings is to use an auxiliary oil pump. Such oil distribution systems are effected by mounting an oil pump on the outside of the vacuum pump housing to pump oil from the reservoir to the bearings and pistons. Such oil pump configurations typically require complicated plumbing, valving and manifolds which drive up the purchase cost of the vacuum pump, as well as the maintenance and operating costs.

SUMMARY AND OBJECTS OF THE INVENTION

The invention concerns an oil distribution system having an integral oil pump for distributing sealing and lubricating oil to pistons, bearings and other components within a vacuum pump or other machine. The invention comprises a shaft rotatably mounted on a bearing, which is preferably the main drive shaft of a vacuum pump. The shaft has a longitudinal passage which extends from one end at least to a point adjacent to a bearing. A port extends from the passage and exits the shaft adjacent to the bearing. An oil pump is positioned within the vacuum pump adjacent to the end of the shaft from which the passage extends. The oil pump is operatively connected to the shaft by means which permit the shaft to drive the oil pump when the shaft rotates. The oil pump has an inlet for admitting oil and an outlet which is connected to the passage within the shaft. When the shaft turns, it drives the oil pump which pumps the oil supplied to the inlet into the passage of the shaft. The oil travels down the shaft and exits through the port, contacting and thereby lubricating the adjacent bearing. The oil then passes through a metering ring arranged adjacent to the bearing between the bearing and the cylinder and enters the cylinder where it performs its sealing function. A parallel oil feed duct is also provided which communicates between the port and the cylinder. Oil exiting the port is also conducted through the oil feed duct directly into the cylinder to ensure that an adequate supply of oil is provided for sealing the piston/cylinder interface and lubricating the pistons.

In one embodiment of the invention, the oil pump is a vane-type pump having a housing which forms a chamber having a cylindrical sidewall. The oil inlet is disposed in the housing. An eccentric rotor is connected to the shaft and rotates within the housing chamber. The rotor has a sliding vane which extends from the rotor in sealing contact with the chamber sidewall. The outlet is arranged concentrically within the rotor and communicates between the chamber and the shaft passage. Oil supplied to the inlet is drawn into the chamber as the rotor turns and forced out through the outlet into the passage. The oil travels through the passage and exits the port to lubricate the bearing and seal the piston, as described above.

In the presently preferred embodiment, a gerotortype oil pump is used. The gerotor pump has a housing forming a chamber and is mounted adjacent to the end of the shaft from which the passage extends. The oil inlet is disposed within the housing and communicates with the chamber. An outer rotor is mounted within the chamber for rotational motion about an axis parallel and eccentric to the vacuum pump drive shaft. The outer rotor has a plurality of teeth projecting radially inwardly toward the axis. An inner rotor is mounted on the shaft and rotates when the shaft rotates. The inner rotor has a plurality of teeth which extend radially outwardly from the shaft and mesh with the outer rotor teeth. As is typical of gerotor pumps, there is one fewer tooth on the inner rotor than on the outer rotor. As the inner rotor turns on the shaft, it causes the outer rotor to rotate within the chamber. The relative eccentricity of the inner and outer rotors in conjunction with the missing tooth on the inner rotor causes a volume between the rotor teeth to increase and diminish in size as the rotors turn. The oil inlet is positioned at the point around the rotor where the volume is increasing, thus, oil is drawn into the housing as the rotor turns. The oil outlet is positioned at the point around the rotor where the volume is decreasing, thus, the oil is forced out from between the rotors through the outlet. The outlet is connected to the passage within the drive shaft, and the oil is thereby pumped into the shaft, travels down the shaft to exit through the port and lubricate the adjacent bearing and seal the pistons.

Other types of oil pumps would also be useable with the invention. Additionally, if the shaft is mounted on a plurality of bearings, then each bearing can be lubricated, as described above, by providing an oil port adjacent to each bearing. To ensure equal distribution of oil to each bearing, no matter how distant along the shaft from the oil pump, the diameter of each oil port can be sized in proportion to the port's distance from the pump. Ports closest to the pump may have smaller diameters than ports farther from the pump. This arrangement of port sizes prevents most of the oil from exiting the ports closest to the pump and starving the farthest bearings of lubricating oil. Additional oil flow control can be effected by adjusting the size of the parallel oil feed ducts located in the side covers of the vacuum pump.

Because the oil is actively pumped from the oil reservoir, the reservoir need not be located above the vacuum pump and use gravity feed. Additionally, the use of a pump renders the presence or absence of a pressure differential between the reservoir and the cylinder immaterial. Thus, adequate oil will flow to the bearings and pistons regardless of whether the reservoir is under vacuum to remove solvents, or a large chamber is being evacuated with the pump running for several minutes with little or no pressure differential to move oil from the reservoir to the bearings.

An oil distribution system according to the invention provides an effective means for distributing sealing and lubricating oil to the moving components of a vacuum pump or other machinery without the need for excessive or complicated plumbing, valving, manifolds and other items otherwise associated with oil distribution systems.

It is an object of the invention to provide an oil distribution system integral with a vacuum pump or other machinery requiring lubrication and/or oil sealing of moving parts.

It is another object of the invention to provide an oil distribution system having a minimum of parts.

It is yet another object of the invention to provide an oil distribution system which does not depend upon gravity to distribute oil to the moving parts.

It is still another object of the invention to provide an oil distribution system which does not depend upon a pressure differential to distribute oil to the moving parts.

DETAILED DESCRIPTION OF THE PREFERRED EMBODIMENT

In the preferred embodiment, the oil distribution system with an integral oil pump according to the invention is used in conjunction with a rotary piston-type type oil-sealed mechanical vacuum pump. The basic components and operation of a rotary piston vacuum pump are described below, although, it is to be understood that the invention is not necessarily limited to this application.

Rotary Piston Vacuum Pump

Figure 1:
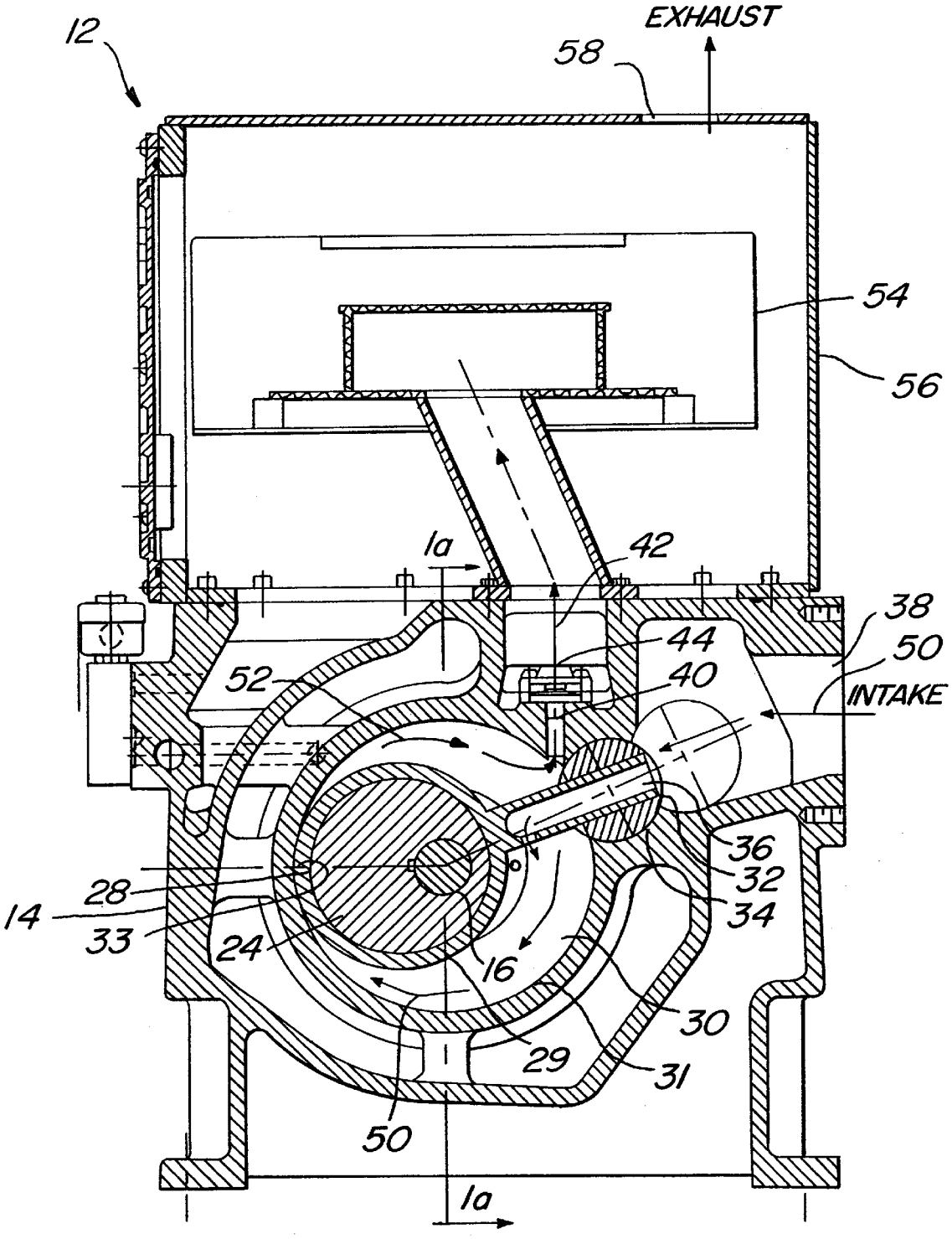
FIG. 1 shows a cross-sectional view of a vacuum pump having rotary pistons.
Figure 1A:
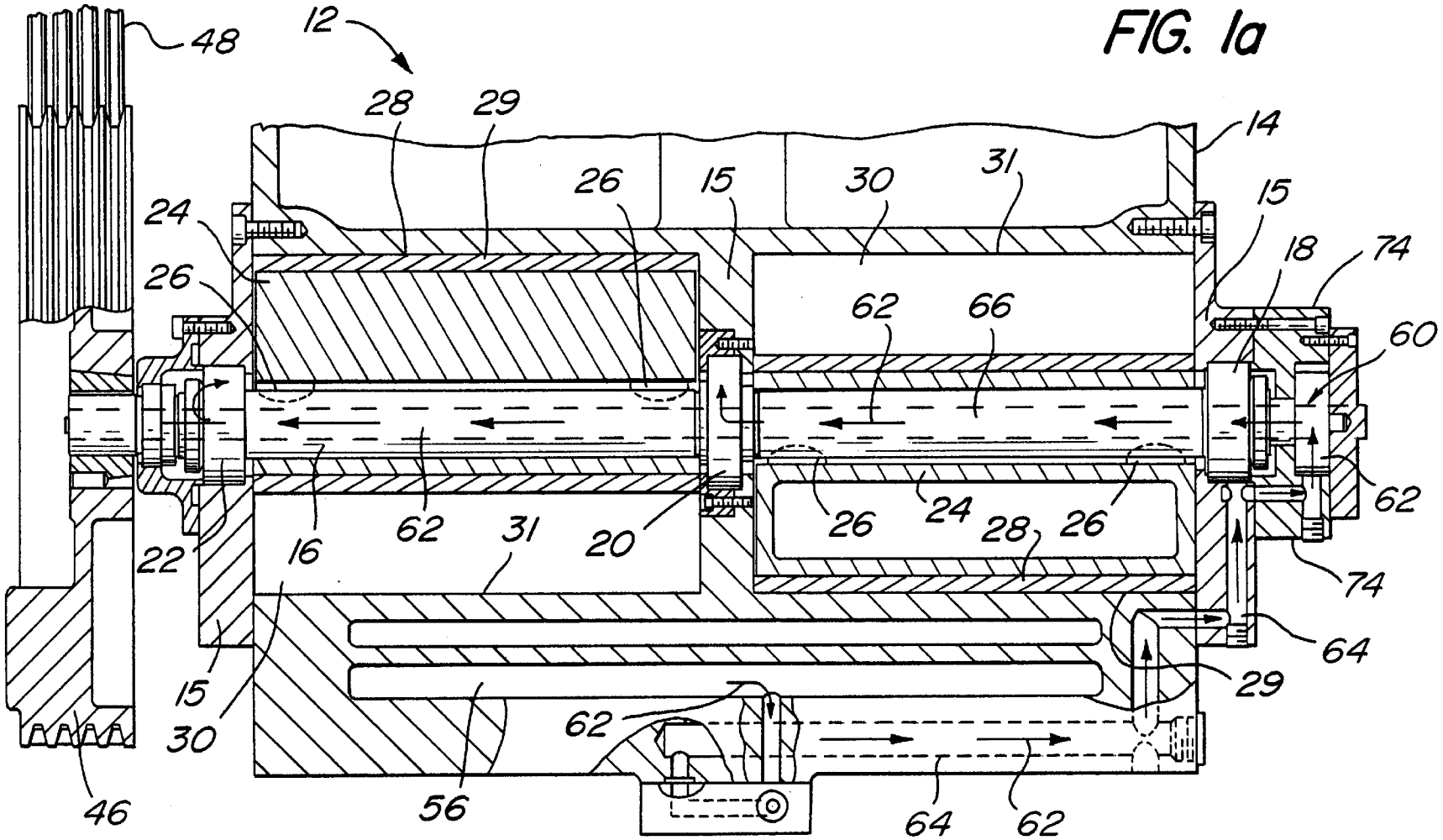
FIG. 1*a* shows a longitudinal cross-sectional view taken along lines 1*a*—1*a* of FIG. 1.

FIGS. 1 and 1*a* show a rotary-piston vacuum pump 12 comprising a casing or housing 14 in which a drive shaft 16 is supported on bearings 18, 20 and 22 arranged at spaced locations lengthwise of the shaft. Eccentrics 24 are mounted on shaft 16 and fixed to rotate with the shaft by keys 26. Rotary pistons 28, each having an exterior surface 29, are mounted respectively on each eccentric 24. Each piston forms a sleeve surrounding its respective eccentric, the eccentric turning within the sleeve and causing the piston to move within a respective cylinder 30 within the pump housing 14. Cylinders 30, along with end walls 15, define cylindrical chambers having cylindrical interior surfaces 31, the piston exterior surfaces contacting the cylindrical interior surfaces at respective tangent points 33.

Each piston has a radially extending piston slide 32 supported in housing 14 by floating hinge bars 34. Hinge bars 34 are free to oscillate in support of slide 32 as the piston moves within cylinder 30. Each piston slide 32 has an intake passage 36 which connects the pump intake 38 to the cylinder 30. An exhaust passage 40 is positioned in the housing on the side of slide 32 opposite intake passage 36. Exhaust passage 40 connects the cylinder 30 with the pump exhaust port 42. A poppet valve 44 is arranged in exhaust passage 40 to prevent a back flow of oil or gases into the cylinder 30.

Shaft 16 is driven by a pulley 46 connected to an electric motor (not shown) by belts 48. As the shaft turns, each eccentric 24 turns with it causing respective pistons 28 to move within respective cylinders 30. The pistons are arranged 180° out of phase to balance the rotating parts of the pump. The description of pump operation which follows illustrates the action of only one piston, it being understood that the same description is applicable to the other piston as well.

Air is drawn into cylinder 30 (as shown by arrows 50 in FIG. 1) through pump intake 38 and intake passage 36 as piston 28 moves away from the pump intake 38 in its motion. As shaft 16 continues to rotate, piston 28 is moved back toward the pump intake. Slide 32 slides within hinge bars 34 closing intake passage 36, thus, trapping a volume of air within cylinder 30. The trapped air volume is displaced around the cylinders as piston 28 continues in its motion. The air is forced out of the cylinder through exhaust passage 40, passing through poppet valve 44 before exiting through exhaust port 42 as shown by arrows 52. The air enters an oil separator 54 where the sealing/lubricating oil is separated and returned to an oil reservoir 56. The air then exits the reservoir 56 through exit port 58.

Oil Distribution System with an Integral Oil Pump

Figure 5:
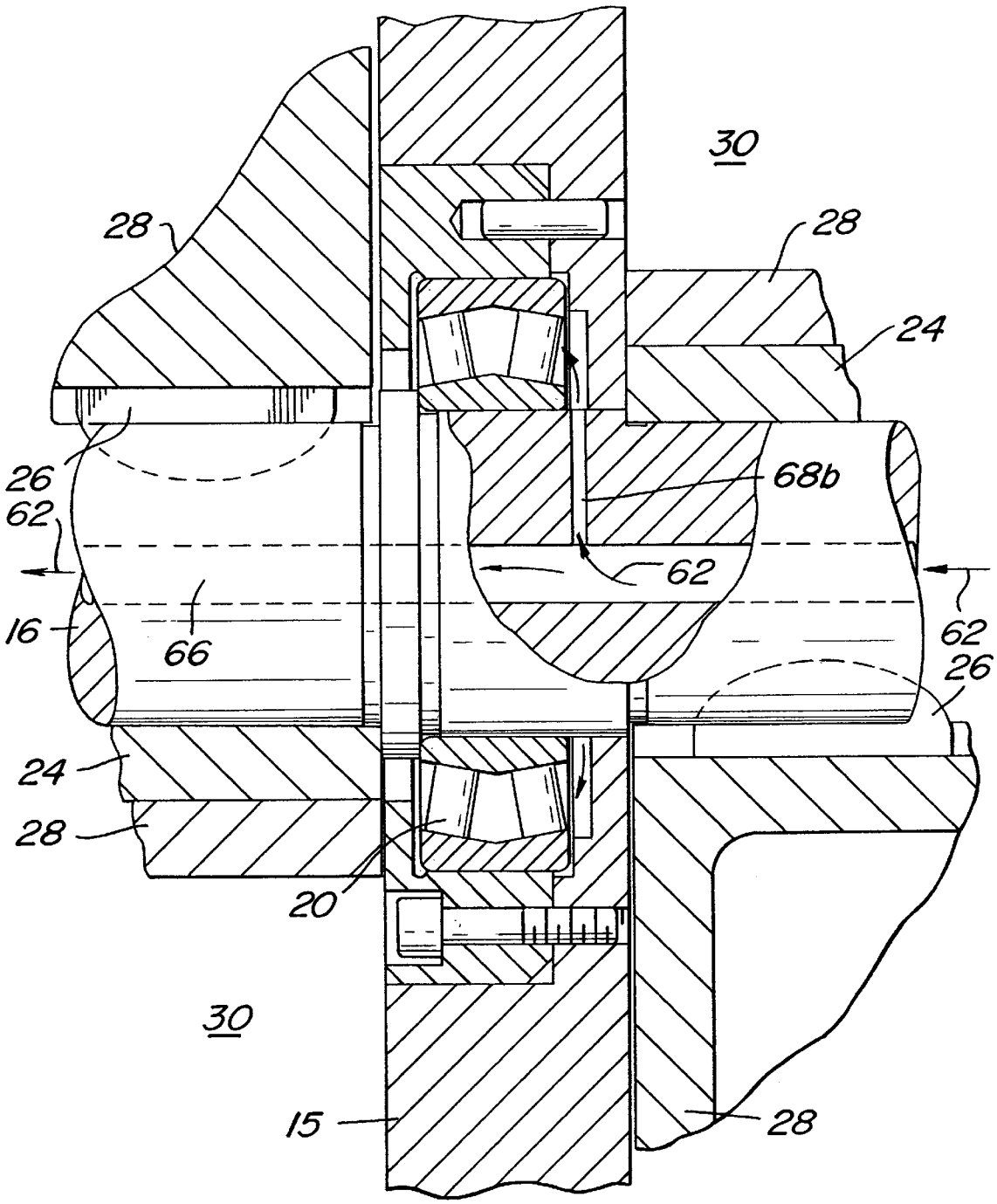
FIG. 5 shows a detailed cross-sectional view on an enlarged scale of the center bearing of the pump shown in FIG. 1*a;*

In the preferred embodiment of the invention, an oil pump 60 is integrally mounted within housing 14 adjacent to one end of shaft 16. As best seen in FIG. 1*a*, sealing/lubricating oil, represented by arrows 62, is drawn from reservoir 56 through oil lines 64 by pump 60. The lines 64 provide an oil conduit for connecting the oil reservoir to the oil inlet of oil pump 60. Shaft 16 has a longitudinal passage 66 extending substantially along its length, the passage communicating with the oil pump inlet by a connecting means such as an oil pump shaft (seen in detail at 89 in FIGS. 2 and 9) extending between the outlet 63 of oil pump 60 and the passage. Oil 62 exits pump 60 into passage 66 from which it is distributed to shaft bearings 18, 20 and 22. Distribution of the oil to the shaft bearings is illustrated in detail in FIGS. 2, 5 and 6. Preferably, the bearings are mounted in end walls 15 of housing 14. As shown in each figure, oil ports 68*a*, 68*b* and 68*c* extend from passage 66 and exit the shaft 16 at a respective point adjacent to each of the bearings 18, 20 and 22. The ports are preferably oriented at right angles to the passage. Oil 62 flows from passage 66 through each port and into bearings 18, 20 and 22. To ensure adequate flow to each bearing, the ports have different diameters sized in proportion to their distance along shaft 16 from pump 60. The oil pressure within passage 66 is greatest nearer the pump and diminishes with distance along the passage. Ports having the same diameter would offer the same resistance to oil flow and, therefore, more oil would exit the high pressure end of the shaft closer to the pump than would exit at the farther end. This could result in oil starvation of the far left bearing 22. To compensate for the oil pressure variation, the closest port 68*a* has the smallest diameter, thereby offering a greater resistance to oil flow out of the passage 66. Port 68*b* is also relatively small because very little oil is required for the center bearing, and port 68*c* has the largest diameter, as seen in the FIGS. 2, 5 and 6. Thus, by varying the relative port diameters in relation to the pressure variation a balanced oil flow to the bearings is achieved.

The oil lubricates and cools the bearings and then passes through metering rings 17 (see FIGS. 2 and 6) mounted adjacent to selected bearings in annular openings 19 in the end walls 15. The annular openings communicate with the interior of cylinder 30. The metering rings each have a circumferential edge 21 which extends radially into the annular opening a predetermined distance, thereby controlling the size of the annular opening and the oil flow therethrough. The oil then enters cylinder 30 where it forms an oil seal between the piston exterior surface 29 and the interior cylindrical surface 31. The seal moves within the cylindrical chamber 30 as the piston moves therewithin. The oil is expelled from the pump through exhaust passage 40, exhaust port 42 and poppet valve 44 along with the air in the cylinder. The oil is separated from the air by oil separator 54 and returned to the reservoir to be reused.

Figure 6:
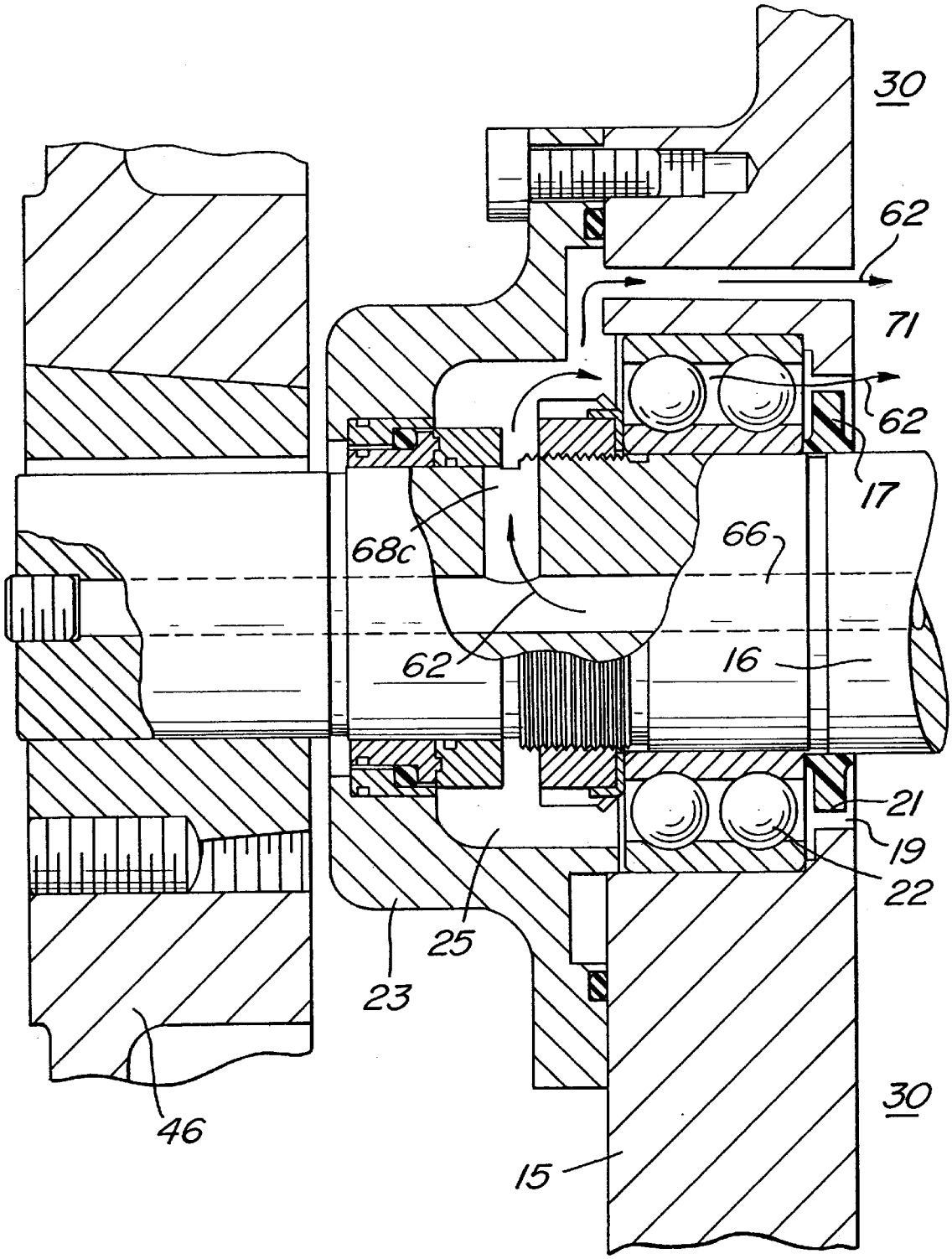
FIG. 6 shows a detailed cross-sectional view on an enlarged scale of the left-most bearing of the pump shown in FIG. 1*a;*
Figure 7:
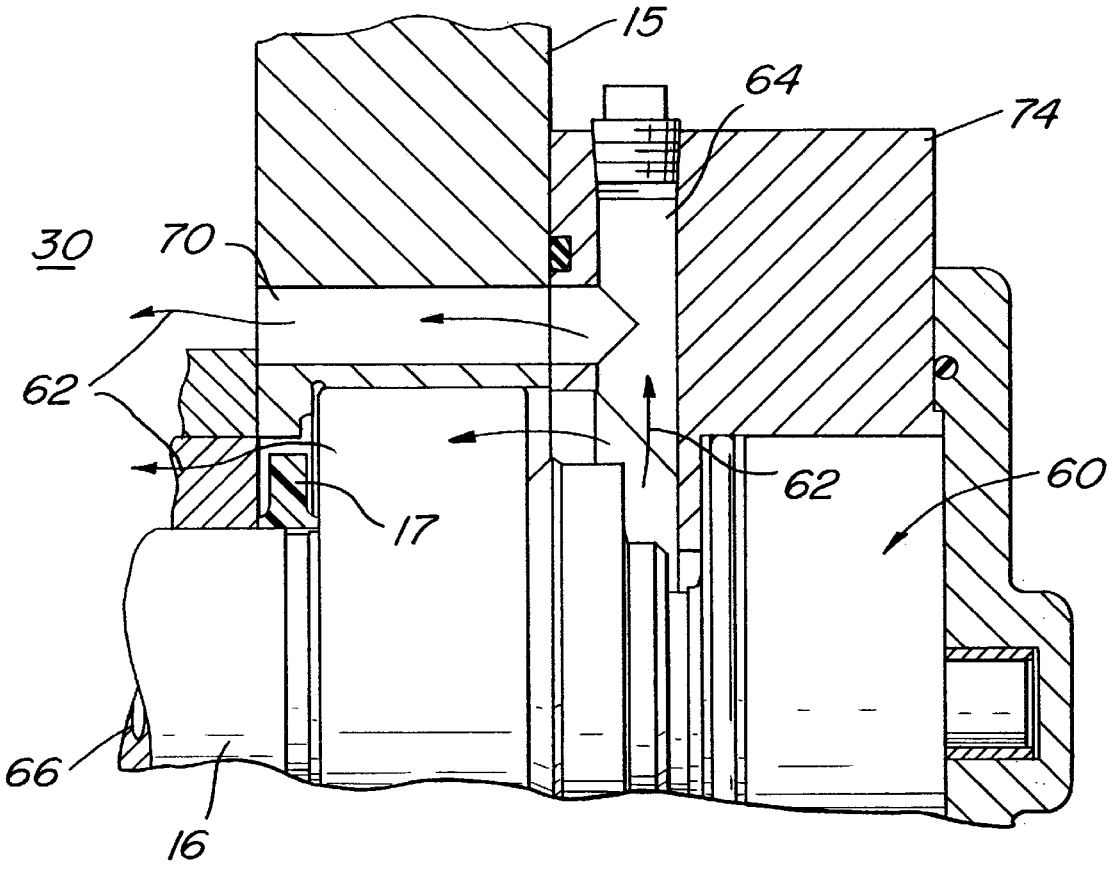
FIG. 7 shows a detailed cross-sectional view of the right-most portion of the pump shown on an enlarged scale.

As shown in FIGS. 6 and 7, other oil ducts 70 and 71 communicate with ports 68*a* and 68*c* to feed oil 62 from the pump 60 directly into cylinder 30 to ensure that sufficient oil is present to lubricate the pistons and effect the piston-cylinder seal. FIG. 6 shows an end cap 23 mounted on end wall 15. End cap 23 surrounds the end of shaft 16 and defines a volume 25 which provides a connecting means between oil port 68*c* to oil duct 71, thus, allowing the oil 62 to flow both directly into cylinder 30 or through bearing 22 and metering ring 17 and then into the cylinder. FIG. 7 shows a partial cross section located behind the cross-section of FIG. 2. Oil flow through the system can also be controlled by adjusting the diameters of oil ducts 70 and 71 in relation to ports 68*a*–68*c* to ensure a balanced flow of oil to lubricate the bearings and sufficient oil flow to seal the pistons 28 in cylinders 30.

Rotary Vane-Type Pump

Figure 2:
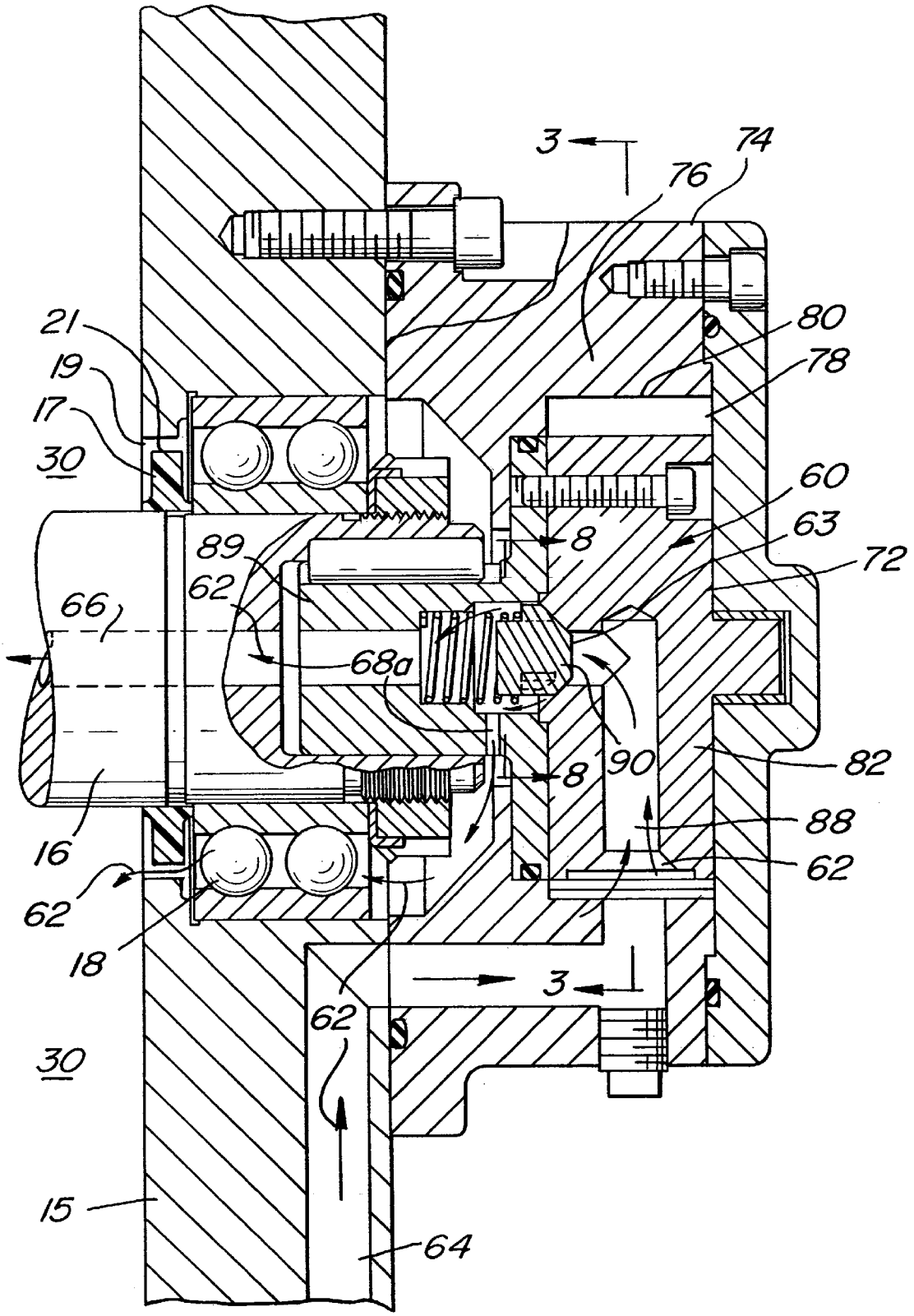
FIG. 2 shows a detailed cross-sectional view on an enlarged scale of the right-most bearing and oil pump of the vacuum pump shown in FIG. 1*a;*
Figure 3:
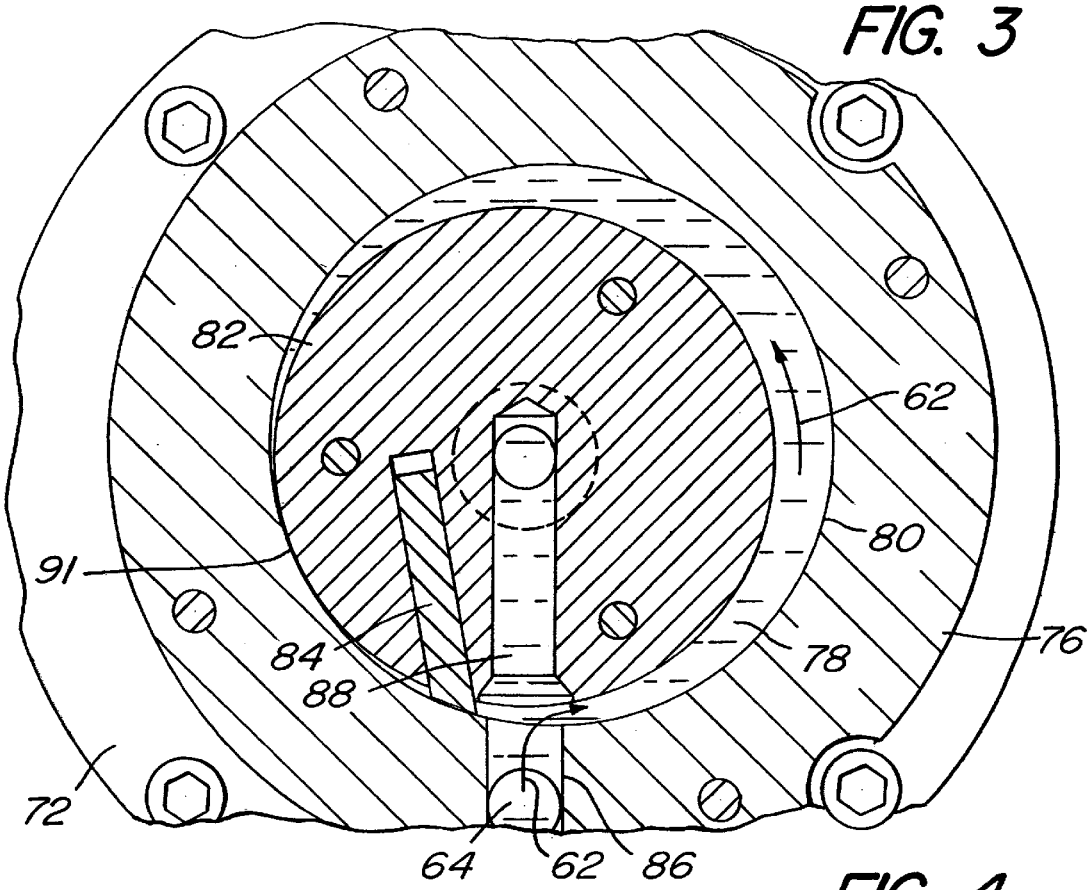
FIGS. 3 and 4 show a cross-sectional view taken along line 3—3 from FIG. 2.
Figure 4:
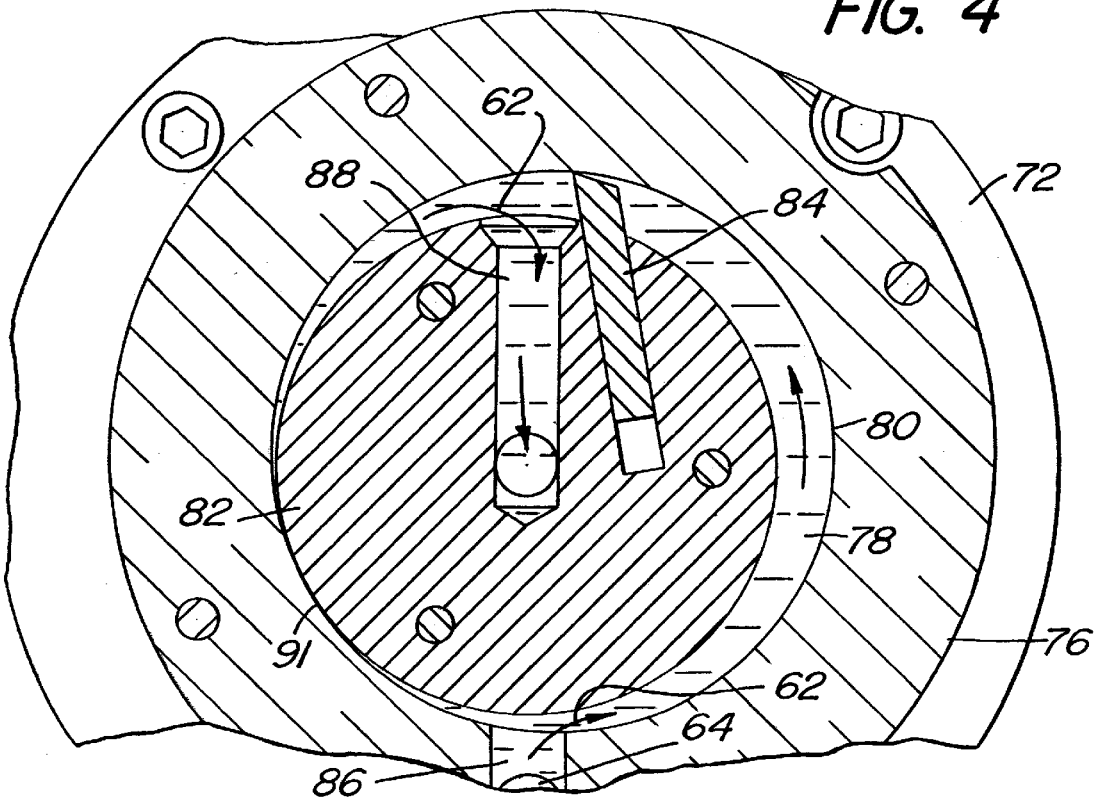

The rotary vane pump 72, shown in FIG. 2, is one example of a pump usable with the oil distribution system according to the invention. The vane pump is inexpensive, simple in design, reliable in operation and relatively compact and therefore easily integrable within the end cap 74 of the vacuum pump 12. The vane pump is preferred when solid contaminants, such as dirt or debris, are not present in the oil. Vane pump 72 has a housing 76 which forms a chamber 78 having a cylindrical sidewall 80. A rotor 82 is eccentrically positioned within chamber 78 and provides the drive connection means for operatively connecting vane pump 72 to shaft 16. Rotor 82 is connected directly to shaft 16 which drives the rotor. As seen in FIGS. 3 and 4, a vane 84 is slidably mounted within the rotor. The vane extends from the rotor under centrifugal force during rotation and is in sealing contact with sidewall 80.

Figure 8:
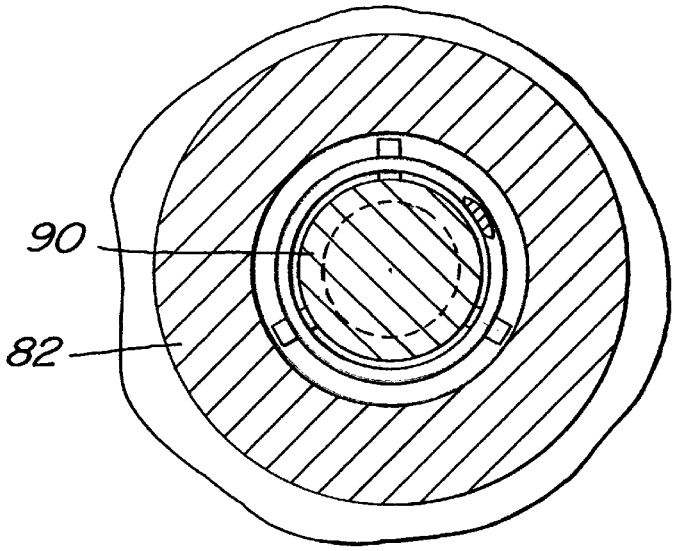
FIG. 8 shows a detailed cross-sectional view on an enlarged scale taken along line 8—8 of FIG. 2.

Vane pump 72 has an oil inlet 86 located in pump housing 76. Inlet 86 communicates with oil reservoir 56 through oil conduit 64. An oil outlet 88 is located within rotor 82 and communicates with longitudinal passage 66 within shaft 16 by means of oil pump shaft 89. As seen in FIG. 2, a spring-biased check valve 90 is interposed between oil outlet 88 and longitudinal passage 66 to prevent the flooding of oil into the cylinder(s) from the reservoir when the vacuum pump is stopped. Check valve 90 is preferably circular in cross section, as seen in FIG. 8. Not shown, but considered to be part of the oil pump mechanism when specified is a pressure relief valve that will port high pressure oil from the pump outlet 63 to the oil pump suction port represented by oil line 64 to relieve oil pressure should the spring biased check valve 90 fail to open or the lateral oil pump passages become plugged with debris.

FIGS. 3 and 4 best illustrate the operation of rotary vane pump 72. Rotor 82 rotates with shaft 16, and as vane 84 passes oil inlet 86, oil 62 is drawn into chamber 78 from oil line 64. As the rotation continues, oil drawn into the chamber on the previous rotation is trapped between vane 84 and the point of contact 91 between rotor 82 and sidewall 80. The oil is forced into oil outlet 88 as the vane advances, as seen in FIG. 4. As seen in FIG. 2, oil outlet 88 extends from the chamber 78 through the center of rotor 82, past check valve 90 and into longitudinal passage 66 of shaft 16. The oil continues down the passage to be distributed to the shaft bearings through ports 68, as described above.

Gerotor-Type Pump

Figure 9:
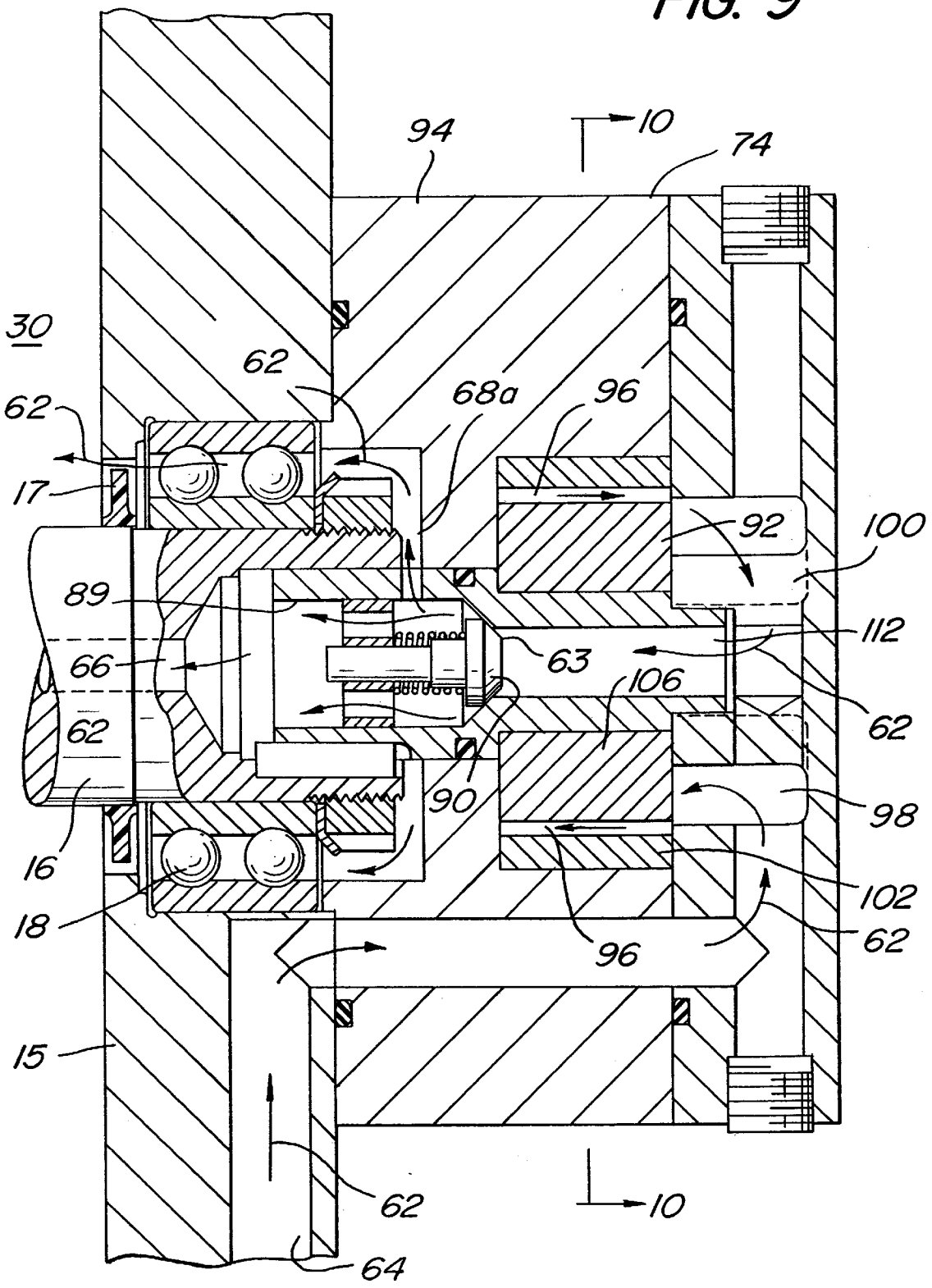
FIG. 9 shows a detailed cross-sectional view on an enlarged scale of the right-most bearing and an alternate oil pump for the vacuum pump shown in FIG. 1*a*.
Figure 10:
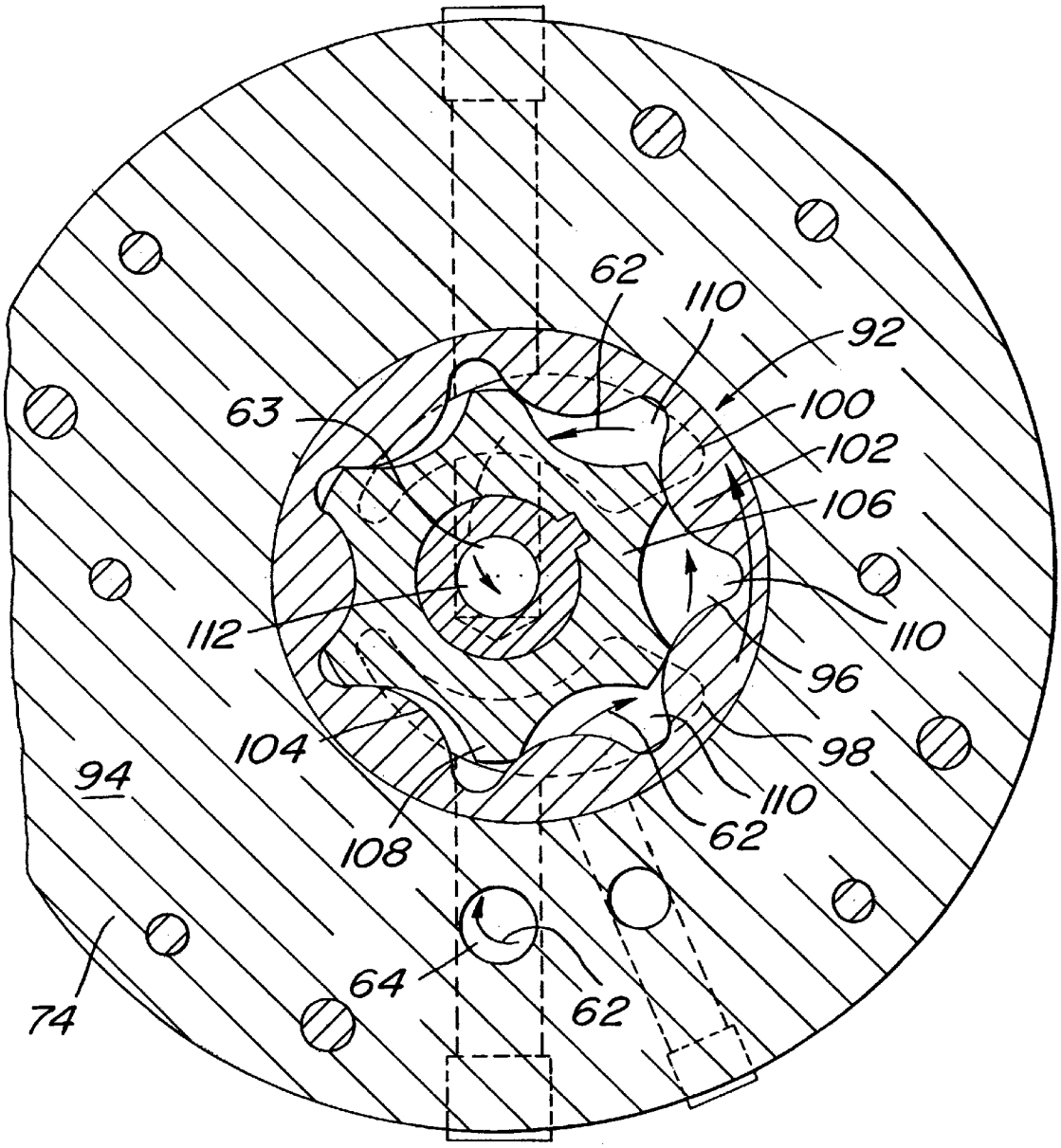
FIG. 10 shows a cross-sectional view taken along line 10—10 of FIG. 9.

In an alternative embodiment, a gerotor pump 92, illustrated in FIGS. 9 and 10, is used for the oil lubrication system according to the invention. Like the rotary vane-type pump, the gerotor is compact and therefore easily integrated into the end cap 74 of vacuum pump 12. The gerotor-type pump is also reliable in operation and simple in design, and although more expensive than the vane-type pump, is presently considered to be preferred for this application, as it is more robust and better able to tolerate solid contamination such as dirt in the oil.

Gerotor pump 92 comprises a housing 94 positioned within end cap 74 adjacent to one end of shaft 16. The housing forms a chamber 96 and an oil inlet 98 (shown in phantom line in FIG. 10) communicating between the chamber and oil line 64. The housing 94 also forms an oil outlet 100 (shown in phantom line in FIG. 10) which communicates between the chamber and longitudinal passage 66 by means of oil pump shaft 89.

An outer rotor 102 is positioned within chamber 96. Outer rotor 102 has a plurality of radially oriented inwardly extending teeth 104 arrayed circumferentially. The outer rotor is free to rotate within chamber 96. An inner rotor 106 is attached to shaft 16 and rotates with it. Inner rotor 106 has radially extending teeth 108 which intermesh with outer rotor teeth 104. The inner rotor has one less tooth than the outer rotor, and the outer rotor is eccentrically positioned with respect to the inner rotor. This rotor configuration yields a free volume 110 on the left side of the chamber 96, as seen in FIG. 10. Oil inlet 98 and oil outlet 100 both communicate with free volume 110 through which oil 62 passes as it is pumped from the reservoir to the longitudinal passage 66 as described below.

Lubricating oil 62 is drawn from reservoir 56 through oil line 64. As seen in FIG. 9, oil line 64 communicates with chamber 96 through oil inlet 98. FIG. 10 shows that as inner rotor 106 rotates counterclockwise with shaft 16, meshing teeth 104 and 108 separate, forming free volume 110. Oil 62 is drawn into the free volume from the overlying inlet 98. The rotor teeth are in sealing contact as they rotate and the oil is displaced around the chamber 96 as the rotors turn. The oil is forced into oil outlet 100 as the teeth intermesh again on the right side of chamber 96, collapsing the free volume. As seen in FIG. 9, the oil 62 forced from free volume 110 enters oil outlet 100 and then passes to longitudinal passage 66 through a center bore 112 in inner rotor 106 communicating with oil pump shaft 89. Again, a spring-biased check valve 90 is interposed between the pump and the passage to prevent oil from the reservoir from flooding the cylinder when the vacuum pump is stopped. A pressure relief valve, not shown but previously described, is also used in conjunction with the gerotor pump.

The oil distribution system with an integral oil pump according to the invention provides a means for including an auxiliary oil pump in machinery such as a vacuum pump. The invention avoids the use of complex piping, valving, manifolds and other items normally associated with lubrication systems. The distribution system according to the invention further ensures adequate oil flow to all of the bearings, pistons and pump operation such as oil reservoir position or the presence or absence of partial vacuum within the pump.

What is claimed is:

1. An oil distribution system for distributing lubricating oil to a bearing mounted within a vacuum pump comprising a cylinder and at least one rotating piston arranged within the cylinder, the cylinder being arranged adjacent to one side of the bearing, the bearing being in fluid communication with the cylinder, said oil distribution system comprising:

a shaft supported on the bearing for rotational motion of said shaft, the piston being mounted on said shaft, said shaft having a longitudinal passage extending from one end to at least a point adjacent to the other side of the bearing;

a port extending from said passage and exiting said shaft at about said point adjacent to the other side of said bearing;

a pump positioned adjacent to said one end of said shaft, means operatively connecting said pump to said shaft for driving said pump when said shaft rotates, said pump having an inlet for admitting the lubricating oil to said pump and an outlet connected to said passage for discharging the lubricating oil into said passage, the lubricating oil exiting said passage through said port and passing through and lubricating the bearing, the lubricating oil entering said cylinder after passing through the bearing and providing an oil seal between the piston and the cylinder.

2. An oil distribution system according to claim 1, further comprising an end cap enclosing said one end of said shaft, said pump being positioned within said end cap.

3. An oil distribution system according to claim 2, wherein said pump comprises a vane-type pump comprising:

a housing forming a chamber having a cylindrical sidewall, said inlet being disposed in said housing;

an eccentric rotor connected to said shaft and rotating therewith within said housing, said rotor having a vane slidably mounted therein and extending from said rotor in sealing contact with said sidewall, said outlet being arranged within said rotor and communicating between said chamber and said passage.

4. An oil distribution system according to claim 2, wherein said pump comprises a gerotor-type pump comprising:

a housing having a chamber therein, said inlet being disposed in said housing;

an outer rotor mounted within said chamber for rotational motion about an axis parallel and eccentric to said shaft, said outer rotor having a first plurality of teeth projecting radially inwardly toward said axis;

an inner rotor mounted on said shaft, said inner rotor having a second plurality of teeth extending radially from said shaft in intermeshing engagement with said first plurality of teeth, said second plurality of teeth having one less tooth than said first plurality, said outlet being disposed within said inner rotor and communicating between said chamber and said passage.

5. An oil distribution system according to claim 1, wherein said shaft is substantially horizontally oriented.

6. An oil distribution system according to claim 1, wherein said port is oriented at a right angle to said passage.

7. An oil distribution system according to claim 1, further comprising an oil duct providing fluid communication between said port and said cylinder, said oil duct providing a direct path for oil exiting said shaft and entering said cylinder for providing an oil seal between said piston and said cylinder.

8. An improved vacuum pump comprising a housing, and a pair of cylinders within said housing, each cylinder having a gas intake port and a gas exhaust port, a pair of rotating pistons, one of said pistons being arranged within each said cylinder, an oil reservoir containing lubricating oil, and means for maintaining said oil reservoir at a partial vacuum, the partial vacuum allowing for the separation of volatile contaminants from the oil by evaporation, wherein the improvement to the vacuum pump comprises:

an elongated shaft arranged within the housing for driving the pistons, the pistons being eccentrically mounted on said shaft, said shaft having a passage extending axially from one end;

a plurality of bearings arranged at spaced locations lengthwise of said shaft for rotatably mounting said shaft;

a plurality of oil ports arranged in said shaft, said oil ports communicating between said passage and the outer surface of said shaft, at least one of said oil ports being arranged adjacent to each of said bearings; and an oil pump for supplying oil to said bearings, and further comprising means for drawing the oil from the reservoir against the partial vacuum, said oil pump being mounted adjacent to said one end of said shaft, said oil pump having an oil inlet communicating with the oil reservoir and an oil outlet communicating with said passage for pumping the oil from the reservoir into said passage, the oil pumped therein exiting said passage through said oil ports and thereby lubricating said bearings, the oil being further pumped from the cylinder by the pistons through the gas exhaust port and returned to the reservoir.

9. An improved vacuum pump according to claim 8, wherein said oil pump comprises a vane-type pump comprising:

an oil pump housing forming a chamber having a cylindrical side wall, said oil pump housing being mounted on said vacuum pump adjacent to said one end of said shaft, said oil inlet being disposed in said oil pump housing and communicating between the reservoir and said chamber;

an eccentric rotor mounted on said shaft and rotating therewith within said oil pump housing, said rotor having a vane slidably mounted therein and extending from said rotor in sealing contact with said sidewall, said oil outlet being arranged within said rotor and communicating between said chamber and said passage.

10. An improved vacuum pump according to claim 9, further comprising an end cap enclosing said one end of said shaft, said oil pump being positioned within said end cap.

11. An improved vacuum pump according to claim 8, wherein said oil pump comprises a gerotor-type pump comprising:

an oil pump housing mounted on said vacuum pump adjacent to said one end of said shaft, said oil pump housing having a chamber therein, said oil inlet being disposed in said oil pump housing and communicating between the reservoir and said chamber;

an outer rotor mounted within said chamber for rotational motion about an axis parallel and eccentric to said shaft, said outer rotor having a first plurality of teeth projecting radially inwardly toward said axis;

an inner rotor mounted on said shaft, said inner rotor having a second plurality of teeth extending radially from said shaft in intermeshing engagement with said first plurality of teeth, said second plurality of teeth having one less tooth than said first plurality, said oil outlet being disposed within said inner rotor and communicating between said chamber and said passage.

12. An improved vacuum pump according to claim 11, further comprising an end cap enclosing said one end of said shaft, said oil pump being positioned within said end cap.

13. An improved vacuum pump according to claim 8, further comprising a check valve interposed between said oil outlet and said passage.

14. An improved vacuum pump according to claim 8, further comprising a first oil port having a first cross sectional area and a second oil port having a second cross sectional area, said first oil port being disposed farther along said shaft from said oil pump than said second oil port, said first cross sectional area being relatively larger than said second cross sectional area.

15. An improved vacuum pump according to claim 8, wherein said oil reservoir is arranged at a level below said shaft, said oil pump operating against gravity to pump the oil into said passage.

16. An improved vacuum pump according to claim 8, further comprising at least one oil duct in fluid communication with one of said oil ports, said oil duct also being in fluid communication with one of said cylinders and thereby providing a path for said oil from said duct into said cylinder, said oil providing for an oil seal between said piston and said cylinder.

17. A method of lubricating bearings of a vacuum pump, comprising the steps of:

providing a reservoir for lubricating oil;

providing a shaft;

providing at least one bearing mounted within said vacuum pump for supporting said shaft in rotational motion;

providing piston means operatively engaging said shaft for pumping a gas;

providing an axial passage extending from one end of said shaft at least to a point adjacent to said bearing, said passage remaining at atmospheric pressure for a predetermined duration of operation of said vacuum pump;

providing a port adjacent to said bearing and communicating between said passage and said bearing;

providing an oil pump mounted adjacent to said one end of said shaft;

pumping lubricating oil during and after said predetermined duration of operation from said reservoir into said passage and out of said port by driving said pump with said shaft; and directing said lubricating oil from said port onto said bearing.

18. A method according to claim 17, wherein said reservoir is positioned below the level of said shaft, and said pumping step comprises pumping said lubricating oil against the force of gravity.

19. A vacuum pump, comprising:

a pump casing having a cylindrical interior surface and first and second end walls arranged at each end of said cylindrical interior surface, said casing and said end walls defining a cylindrical chamber, each said end wall having an aperture therethrough coaxially aligned with said cylindrical chamber, said pump casing having a gas intake port and a gas exhaust port;

an elongated shaft extending coaxially within said pump casing and having first and second ends extending through said first and second end wall apertures respectively;

a bearing mounted within said first end wall aperture, said shaft being rotatably mounted thereon;

a metering ring mounted on said shaft within said first end wall aperture between said bearing and said cylindrical chamber, said metering ring having a circumferential edge extending radially outwardly and constricting said first end wall aperture;

a piston eccentrically mounted on said shaft for motion within said cylindrical chamber, said piston having an exterior surface contacting said cylindrical interior surface and forming an orbiting seal during said motion for drawing gas into said cylindrical chamber through said intake port and expelling the gas through said exhaust port;

a passage extending axially through said shaft from said first to said second end;

an oil port extending from said passage to the outer surface of said shaft at a position along said shaft proximal to said first end and externally to said first end wall, said oil port being in fluid communication with said bearing;

an oil pump mounted externally to said cylindrical chamber on said second end wall, a drive connection from the second end of said shaft for driving said oil pump upon shaft rotation, said oil pump having an oil outlet and an oil inlet, said outlet communicating with said passage at said second end of said shaft;

an oil reservoir;

a first oil conduit connecting said oil reservoir to said oil inlet;

a means for separating oil from gas connected to said gas exhaust port externally of said cylindrical chamber; and a second oil conduit connecting said oil separating means with said reservoir, the oil being pumped from said reservoir through said passage out of said oil port and then flowing to and thereby lubricating said bearing, said oil further flowing through said first end wall aperture into said cylindrical chamber thereby lubricating said piston and providing said orbiting seal between said piston exterior surface and said cylindrical interior surface, said metering ring controlling the rate of oil flow through said first end wall aperture into said cylindrical chamber, said oil being thereafter expelled from said cylindrical chamber through said gas exhaust port into said oil separating means and returned to said reservoir through said second oil conduit.

20. A vacuum pump according to claim 19, further comprising a first end cap mounted on said first end wall externally of said cylindrical chamber and sealingly enclosing said oil port, said bearing and said first end wall aperture.

21. A vacuum pump according to claim 20, further comprising an oil duct extending through said first end wall from within said first end cap to said cylindrical chamber, said oil duct being in fluid communication with said oil port and providing a pathway for oil to flow from said oil port into said cylindrical chamber.

22. A vacuum pump according to claim 19, wherein said oil pump is mounted coaxially on said shaft, said vacuum pump further comprising a second end cap mounted on said second end wall externally of said cylindrical chamber and sealingly enclosing said oil pump, said shaft second end, and said second end wall aperture.

23. A vacuum pump, comprising:

a pump casing defining a cylindrical interior surface;

first and second end walls arranged at each end of said cylindrical interior surface and a common-wall arranged between said first and second end walls within said casing, said end walls and said common wall defining first and second cylindrical chambers arranged coaxially end to end, each of said walls having a respective aperture therethrough coaxially aligned with said cylindrical chambers, said first cylindrical chamber having a gas intake port and a gas exhaust port;

an elongated shaft having first and second ends, said shaft extending coaxially within said cylindrical chambers through said common wall aperture, said first and second ends extending through said first and second end wall apertures respectively;

a bearing mounted within said first end wall aperture, said shaft being rotatably mounted thereon;

a metering ring mounted on said shaft within said first end wall aperture between said bearing and said first cylindrical chamber, said metering ring having a circumferential edge extending radially outwardly and constricting said first end wall aperture;

a piston eccentrically mounted on said shaft for motion within said first cylindrical chamber, said piston having an exterior surface contacting said cylindrical interior surface and forming an orbiting seal during said motion for drawing gas into said first cylindrical chamber through said intake port and expelling the gas through said exhaust port;

a passage extending axially through said shaft from said first to said second end;

an oil port extending from said passage to the outer surface of said shaft at a position along said shaft proximate to said first end and externally of said first end wall, said oil port being in fluid communication with said bearing;

an oil pump mounted on said second end wall externally to said second cylindrical chamber, a drive connection from the second end of said shaft for driving said oil pump upon shaft rotation, said oil pump having an oil outlet and an oil inlet, said outlet communicating with said passage at said second end of said shaft;

an oil reservoir;

a first oil conduit connecting said oil reservoir to said oil inlet;

a means for separating oil from gas connected to said gas exhaust port and disposed externally of said cylindrical chambers; and a second oil conduit connecting said oil separating means with said reservoir, the oil being pumped from said reservoir through said passage out of said oil port and then flowing to and thereby lubricating said bearing, said oil further flowing through said first end wall aperture into said first cylindrical chamber thereby lubricating said piston and providing said orbiting seal between said piston exterior surface and said cylindrical interior surface, said metering controlling the rate of oil flow through said first end wall aperture into said first cylindrical chamber, said oil being thereafter expelled from said first cylindrical chamber through said respective gas exhaust port into said oil separating means and returned to said reservoir through said second oil conduit.

24. A vacuum pump according to claim 23, further comprising a first end cap mounted on said first end wall externally of said first cylindrical chamber and sealingly enclosing said oil port, said bearing, and said first end wall aperture.

25. A vacuum pump according to claim 23, wherein said oil pump is mounted coaxially on said shaft, said vacuum pump further comprising a second end cap mounted on said second end wall externally of said second cylindrical chamber and sealingly enclosing said oil pump, said shaft second end, and said second end wall aperture.

26. A vacuum pump according to claim 23, further comprising an oil duct extending through said first end wall from within said first end cap to said first cylindrical chamber, said oil duct being in fluid communication with said oil port and providing a pathway for oil to flow from said oil port into said first cylindrical chamber.

27. An improved vacuum pump comprising a housing, and a pair of cylinders within said housing, each cylinder having a gas intake port and a gas exhaust port, a pair of rotating pistons, one of said pistons being arranged within each said cylinder, and an oil reservoir containing lubricating oil, wherein the improvement to the vacuum pump comprises:

an elongated shaft arranged within the housing for driving the pistons, the pistons being eccentrically mounted on said shaft, said shaft having a passage extending axially from one end, said passage remaining substantially at atmospheric pressure for a predetermined duration of operation of said vacuum pump;

a plurality of bearings arranged at spaced locations lengthwise of said shaft for rotatably mounting said shaft;

a plurality of oil ports arranged in said shaft, said oil ports communicating between said passage and the outer surface of said shaft, at least one of said oil ports being arranged adjacent to each of said bearings;

an oil pump for supplying oil to said bearings, said oil pump comprising means for pumping the oil into said passage during said predetermined period of operation, said oil pump being mounted adjacent to said one end of said shaft, said oil pump having an oil inlet communicating with the oil reservoir and an oil outlet communicating with said passage for pumping the oil from the reservoir into said passage, the oil pumped therein exiting said passage through said oil ports and thereby lubricating said bearings, the oil being further pumped from the cylinder by the pistons through the gas exhaust port and returned to the reservoir.

28. A method of lubricating bearings of a vacuum pump, comprising the steps of:

providing a reservoir for lubricating oil;

providing a shaft;

providing at least one bearing mounted within said vacuum pump for supporting said shaft in rotational motion;

providing piston means operatively engaging said shaft for pumping a gas;

providing an axial passage extending from one end of said shaft at least to a point adjacent to said bearing;

providing a port adjacent to said bearing and communicating between said passage and said bearing;

providing an oil pump mounted adjacent to said one end of said shaft;

maintaining said reservoir at a partial vacuum to allow volatile contaminants to evaporate from the lubricating oil therein;

pumping lubricating oil from said reservoir against said partial vacuum into said passage and out of said port by driving said pump with said shaft; and directing said lubricating oil from said port onto said bearing.

* * * * *